US005908112A

United States Patent [19]

Hardie

[11] Patent Number: 5,908,112

[45] Date of Patent: Jun. 1, 1999

[54] TRAVEL CASE FOR A DOLL

[76] Inventor: Susan Ann Hardie, 9607 Salisbury, San Antonio, Tex. 78217

[21] Appl. No.: 08/341,744

[22] Filed: Nov. 18, 1994

Related U.S. Application Data

[63] Continuation-in-part of application No. 08/094,372, Jul. 7, 1993, abandoned.

[51] Int. Cl.[6] ..... B65D 85/00; A63H 3/00; A63H 33/04

[52] U.S. Cl. ..... 206/525; 446/73; 446/75; 190/18 A

[58] Field of Search ..... 383/111; 190/124, 190/125, 18 A, 115; 220/404, 403, 400; 446/72–78; 206/45.31, 45.34, 457, 525

[56] References Cited

U.S. PATENT DOCUMENTS

| | | | |
|---|---|---|---|
| 2,113,427 | 4/1938 | Fleisig | 446/73 X |
| 2,278,124 | 3/1942 | Kowinski | 446/75 X |
| 3,731,420 | 5/1973 | Crosman | 446/73 |
| 4,204,361 | 5/1980 | Chaput | 446/74 |
| 4,979,598 | 12/1990 | Verheij et al. | 190/18 A |
| 5,209,345 | 5/1993 | Haugabook | 446/73 X |

*Primary Examiner*—B. Dayoan
*Attorney, Agent, or Firm*—Cox & Smith Incorporated

[57] ABSTRACT

A travel case for dolls incorporating a doll enclosure having a bottom wall, opposed upstanding end walls and two side walls interconnecting the bottom and end walls. A top wall is provided which is secured to the top edges of the side walls and is inclined relative to the bottom wall. The top wall is provided with an aperture and a cover of clear transparent material is secured to the top wall in overlying relationship to the aperture therein to permit the doll to be observed at all times by the doll owner.

4 Claims, 4 Drawing Sheets

TRAVEL CASE FOR A DOLL

RELATIONSHIP TO PENDING APPLICATIONS

This application is a continuation-in-part of Ser. No. 08/094,372, filed Jul. 7, 1993 and now abandoned.

FIELD OF THE INVENTION

This invention relates to a travel case specifically designed for use by a child to carry a doll and doll accessories, such as clothing and jewelry.

BACKGROUND OF THE INVENTION

As many parents can testify, young children, particularly girls, often become very attached to a particular doll. If the young girl has to travel by plane or train with her parents, it is almost certain that she would want to take the doll with her. There is, therefore, the need for a travel case for dolls.

To the young child, the doll is the equivalent of a another person, resulting in make believe conversations with the doll and a genuine concern as to the doll's welfare. Since the travel experience maybe something new for the particular doll, the young girl owner of the doll would want to make sure as she walks through an airport, that the doll is not concerned by her strange surroundings and, most desirably, the doll can "see" her young girl owner during this new experience.

Any conventional form of luggage into which a doll may be stuffed fails to provide the opportunity for the young girl owner to observe the doll and, more importantly to her, there is no opportunity for the doll to observe her new surroundings and to be assured that her owner is nearby.

Accordingly, there is a need for a doll travel case wherein the doll is visible to its young girl owner and, equally important, the doll can "see" her surroundings and the young girl owner, and thus be comforted during the new experience. Obviously, the doll travel case should resemble, as far as possible, the travel case employed by mother or father and hence should preferably incorporate wheels and a pull strap so that the young girl personally pull the doll case through the airport and onto the plane. Of course, any young girl owner of a doll would insist that the doll have a change of clothes accompanying her, and possibly a change of accessories such as doll jewelry to match the clothes. A doll travel case thus should also provide room for the doll clothes and doll accessories.

SUMMARY OF THE INVENTION

The first embodiment of the present invention provides a doll travel case which meets all of the aforestated requirements. Regardless of whether it is formed of hard or soft, leather like plastic materials, or durable cloth mounted over a wire frame, the doll case of the preferred embodiment of the present invention incorporates a generally horizontal base, which preferably is of generally rectangular configuration, but preferably having rounded corners. The base thus has two opposed elongated side edges and two opposed short end edges. A pair of upstanding end walls are respectively secured to the end edges of the base but one of the end walls has a height substantially less than the other end wall. A pair of upstanding side walls are respectively secured to the side edges of the base and are, of course, secured to the vertical edges of the end walls to form an enclosure. Each of the upstanding side walls has an inclined top edge which connects the top edge of the lower one of the upstanding end walls to the higher one of the upstanding end walls.

A generally rectangular top wall, similar in configuration to the base is perimetrically secured to the top edges of the upstanding side and end walls and thus lies in a plane inclined relative to the horizontal base. The top wall defines an opening of a size sufficient to permit insertion of a doll therethru. If the doll is fairly large, she may be seated on the base with her back against the higher one of the end walls. A transparent plastic flap is provided having a configuration which permits it to overlie the opening in the top wall. A portion of the perimeter of the transparent flap is permanently foldably secured to the top wall, while the remainder of the perimeter of the transparent flap is detachably secured to the end wall by either a zipper or strips, as by the well known Velcro® strips having a plurality of plastic hooks secured to the perimeter of either the transparent flap or the top wall opening and cooperating with a strip having a plurality of plastic loops surrounding the unsecured portions of the perimeter of the top wall or the transparent flap, as the case may be.

For smaller dolls, a modification of this invention provides a doll support shelf which is detachably supported on internally projecting ribs formed on each of the side walls and end walls and located between the base of the case and the top wall. The space below the detachable shelf can then be employed for the packing of doll clothes and accessories, and, after the shelf is inserted in the case in a horizontally inclined position generally parallel to the top wall, the doll can be laid on the doll shelf and the transparent flap closed.

A second embodiment of the present invention provides a doll case that incorporates a generally horizontal base. This base is generally rectangular in shape with generally rounded corners. That base has two opposing elongated side edges and two opposing short end edges. A pair of upstanding end walls are oppositely and respectively secured to the end edges of the base. One of the upstanding end walls has a height equal to or slightly less than the other end wall. A pair of upstanding side walls are respectively secured to the side edges of the base and are secured to the vertical edges of the end walls to form a box-like enclosure. The top surfaces of all the upstanding walls lie in a common plane.

The doll case of the second embodiment of the present invention has a dome cover. This dome cover has a substantially arcuate vertical cross-section configuration. The dome is comprised of a top wall that is interconnected to depending front, rear, and side walls. Those depending walls define a generally rectangular bottom periphery conforming to the shape of the top edges of the side walls of the bottom enclosure. One of the side walls has at least one hinge mounted thereon. The hinge is also connected to the bottom enclosure, allowing the dome to be moved from a closed position abutting the top edge of the bottom enclosure to an open position exposing the interior of the bottom enclosure. One of the side walls has at least one clasp mounted thereon for detachably securing the dome to the bottom enclosure when the dome is in the closed position.

The dome's top wall has a generally curving shape that is defined by its top wall and its interconnected depending side walls. The top wall has a generally curving aperture disposed therein that conforms to the general curve of the top wall and extends partially into the side walls. A sheet of transparent material is provided to cover that aperture. That material is curved in the vertical plane to conform to the contour of the top wall and is suitably secured to the edges of the aperture disposed in the top wall by adhesive or Velcro® strips.

As in the previous modification, a horizontally inclined shelf may be detachably mounted in the bottom enclosure to support the doll with her head aligned with the transparent dome cover to permit her to "see" her surroundings.

In both embodiments of the present invention, the doll is always visible to its young girl owner and more importantly to the young girl owner, the doll can "see" her surroundings as she passes through the airport and enters the plane.

To facilitate the transport of the case, at least two laterally spaced wheels are mounted on the bottom side of the base, preferably adjacent to the small height end wall of the travel case. A pull strap is then attached to the top end of the opposite end wall so that the child owner of the doll can pull the case through the airport in the same manner that mother or father pulls their luggage. Once on the plane, the doll can readily be removed from the case by opening the detachably secured transparent flap or dome and hence may be comforted by the girl owner as the plane takes off, and later, can be "fed" on a make-believe basis when food is served to the young girl owner.

Other advantages of the doll case embodying this invention will become readily apparent to those skilled in the art from the following detailed description, taken in conjunction with the annexed sheets of drawings, on which are shown two embodiment of the invention.

DETAILED DESCRIPTION OF THE PREFERRED EMBODIMENT

Figure 1:
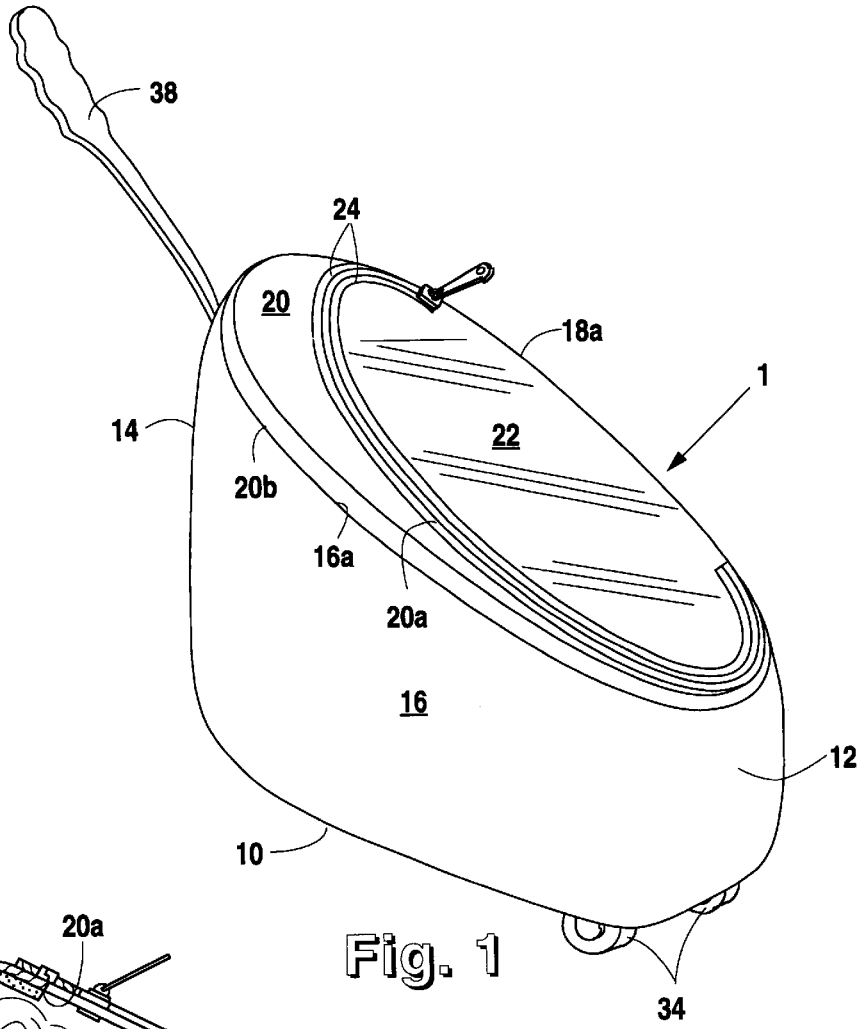
FIG. 1 is a perspective view of the first embodiment of the doll carrying case with the access flap in the secured position.

The first embodiment of the present invention shown in the drawings, as a doll travel case 1, comprises a bottom wall 10 of generally rectangular configuration, but with the corners thereof preferably rounded to improve the appearance of the travel case. Upstanding end walls 12 and 14 are respectively secured to the short sides of the bottom wall 10. The one wall 14, hereinafter referred to as the forward wall, is secured to the forward end of the bottom wall 10. An upstanding wall 12 is secured to the rear edge of the bottom wall 10, but is substantially shorter in height than the forward end wall 14. The side walls 16 and 18 are respectively secured to the longitudinal edges of the generally rectangular bottom wall 10 and are integrally united with the end walls 12 and 14. Thus the top edges 16*a* and 18*a* of the side walls 16 and 18 are respectively inclined at a substantial angle to the horizontal.

Figure 5:
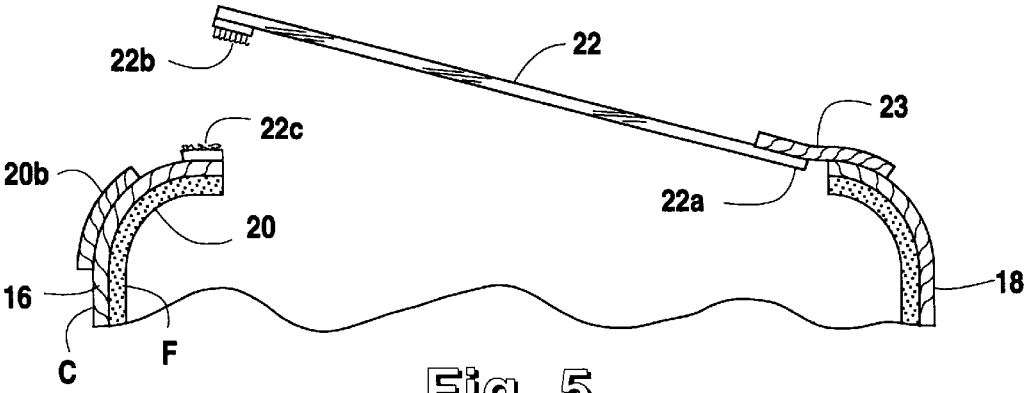
FIG. 5 is a view similar to FIG. 4 but illustrating a further modification of this invention.

A planar top wall 20 is provided which is perimetrically united with the top edges of the aforedescribed front, rear and side walls as by a sewing band 20*b*. Top wall 20 is provided with a large central aperture 20*a* and aperture 20*a* is closed by a overlying panel 22 of a clear transparent, rigid plastic material, such as one of the well known acrylic plastics. A zipper strip 24 may be utilized to detachably secure the periphery of panel 22 to the edges of aperture 20*a*. Alternatively, one edge 22*a* (FIG. 5) of the transparent covering 22 may be hingedly secured to the adjacent edge of the top wall aperture 20 as by a strip of fabric 23 which is glued to a portion of the edge 22*a* of the transparent flap 22 and the adjacent surface of the top wall 20. Velcro® fastening strips 22*c* are adhesively secured to another edge portion of flap 22 and to the top wall 20 around the edges of aperture 22. Thus the transparent flap 22 may be securely retained in aperture closing engagement with the top wall 20 or may be readily separated therefrom and folded by fabric strip 23 to an open position relative to aperture 22.

Figure 3:
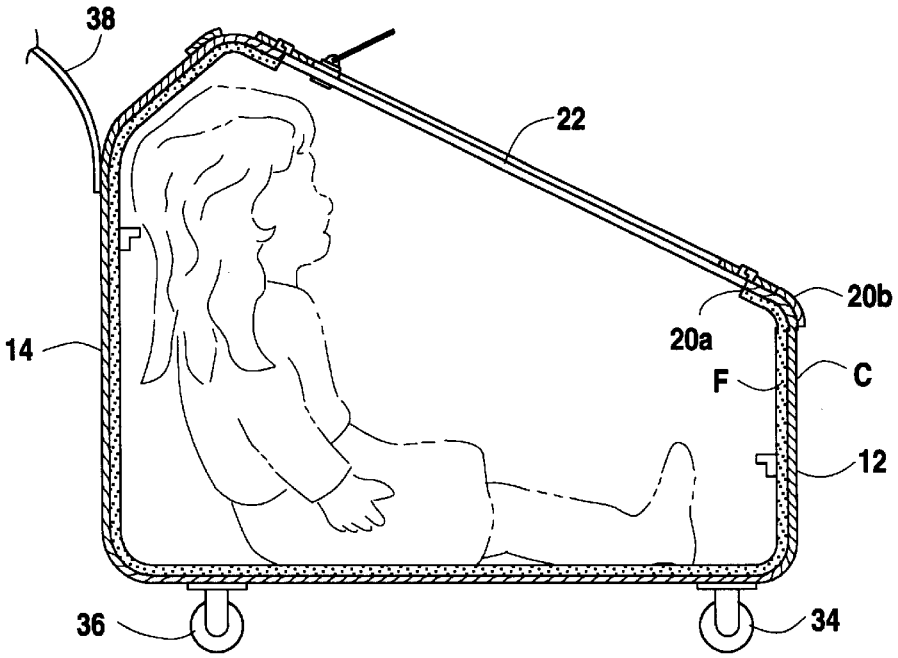
FIG. 3 is a view similar to FIG. 2 but illustrating a modification of the invention.
Figure 4:
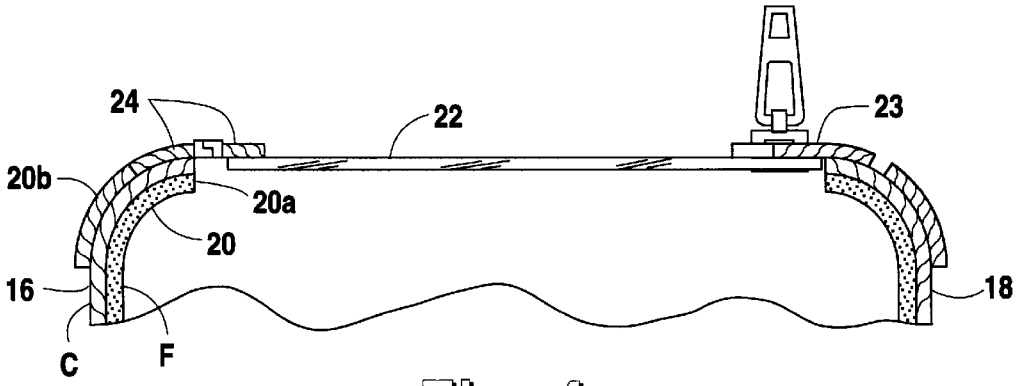
FIG. 4 is a partial transverse vertical sectional view of FIG. 1.

The opening 20*a* in the top wall 20 is preferably of a size sufficient to permit the insertion of the doll in the travel case. The present invention as shown in FIG. 3 has the doll positioned in a upright sitting position on the bottom wall 10 with the back of the doll supported by the forward end wall 20. In this position, the doll can be readily observed by the doll's owner through the transparent flap 22 and, more importantly insofar as the doll's owner is concerned, the doll can readily "see" through the transparent flap 22 and observe her surroundings.

Figure 2:
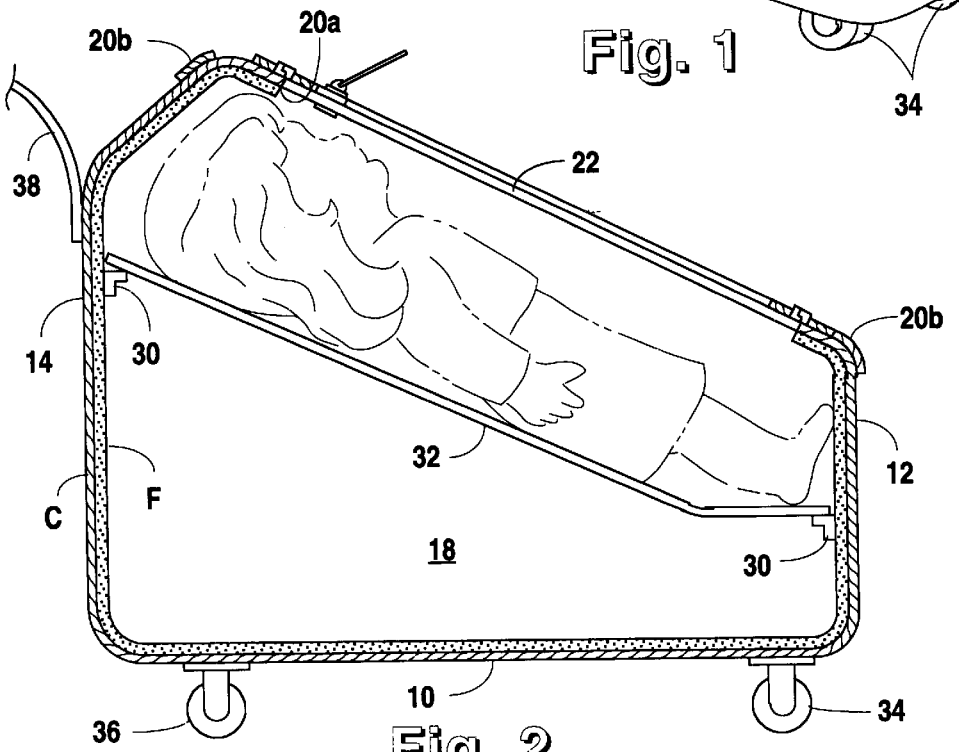
FIG. 2 is a vertical sectional view taken through the longitudinal center of the FIG. 1.

The embodiment of the invention shown in FIG. 2 differs in that inwardly projecting ribs 30 providing an inclined peripheral ledge are suitably formed or adhesively secured around the interior of the upstanding walls of the travel case 1. The ledge 30 is positioned above bottom wall 10 and sufficiently below the top wall 20 as to permit the doll to be laid on a rigid shelf 32 which is supported on the ledge 30. It should be noted that the shelf 32 is inclined so as to generally follow the contour of the top wall 20. Accordingly, the doll will again be in a position where the head of the doll is above the rear wall. Thus, the doll can be readily observed by the doll owner and the doll can "see" through the transparent flap and observe her surroundings.

The space below shelf 32 may be conveniently utilized to pack doll clothes and accessories. Shelf 32 can be readily removed through top wall aperture 20*a* to facilitate packing and unpacking.

Since the luggage utilized by many parents often involves wheels and a pull strap, a pair of transversely spaced wheels 34 may be provided in depending relationship to the rigid bottom wall 10 and located adjacent wall 12. A third wheel 36 may be provided on bottom wall 10 adjacent the forward end wall 14 so as to permit the case to readily roll on the surfaces normally encountered in an airport. Lastly, a pull strap 38 may be suitably secured to the upper portions of the forward end wall 14 to permit the doll owner to readily pull the doll travel case 1 through an airport.

The doll travel case 1 may be constructed in accordance with any one of several well known methods of fabricating travel luggage. For example, the travel case could be formed of rigid plastic material and injection molded in two half parts which are then united by ultrasonic welding along a vertical plane splitting the center of the top wall portions 20 and the bottom wall portion 10. Alternatively, with the exception of the bottom wall, which would be preferably formed from a reasonably rigid material such as rigid plastic, pressed wood or fiber board, the end walls, top walls and side walls may be fabricated from a cloth material C to which is adhered a layer of foam material F on the order of 1/8–1/4" thick to impart sufficient rigidity to the side, end and top walls to perform their functions. The walls are then secured together by sewing or adhesive. Of course, a wire frame may be employed around which is mounted a flexible cloth or plastic material. Alternatively, all of the side walls may be formed from a unitary piece of foam reinforced cloth which is then secured to the perimeters of the bottom wall 10 and top wall 20 by adhesive or sewing. In other words, any of the techniques presently available in the art of manufacturing luggage can be employed to fabricate the aforedescribed embodiments of this invention.

Figure 6:
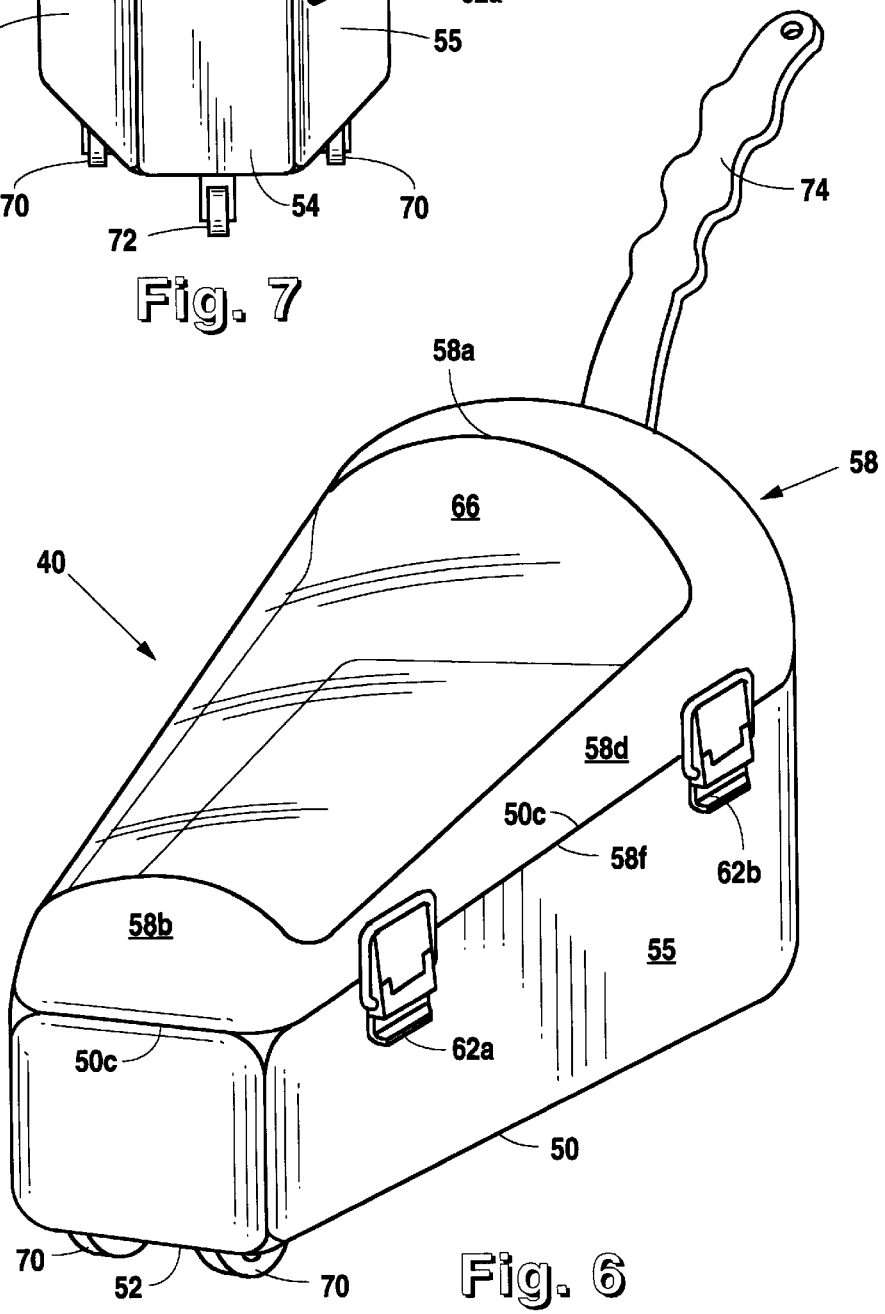
FIG. 6 is a perspective view of the now preferred embodiment of the doll carrying case with a dome cover shown in the secured position.
Figure 8:
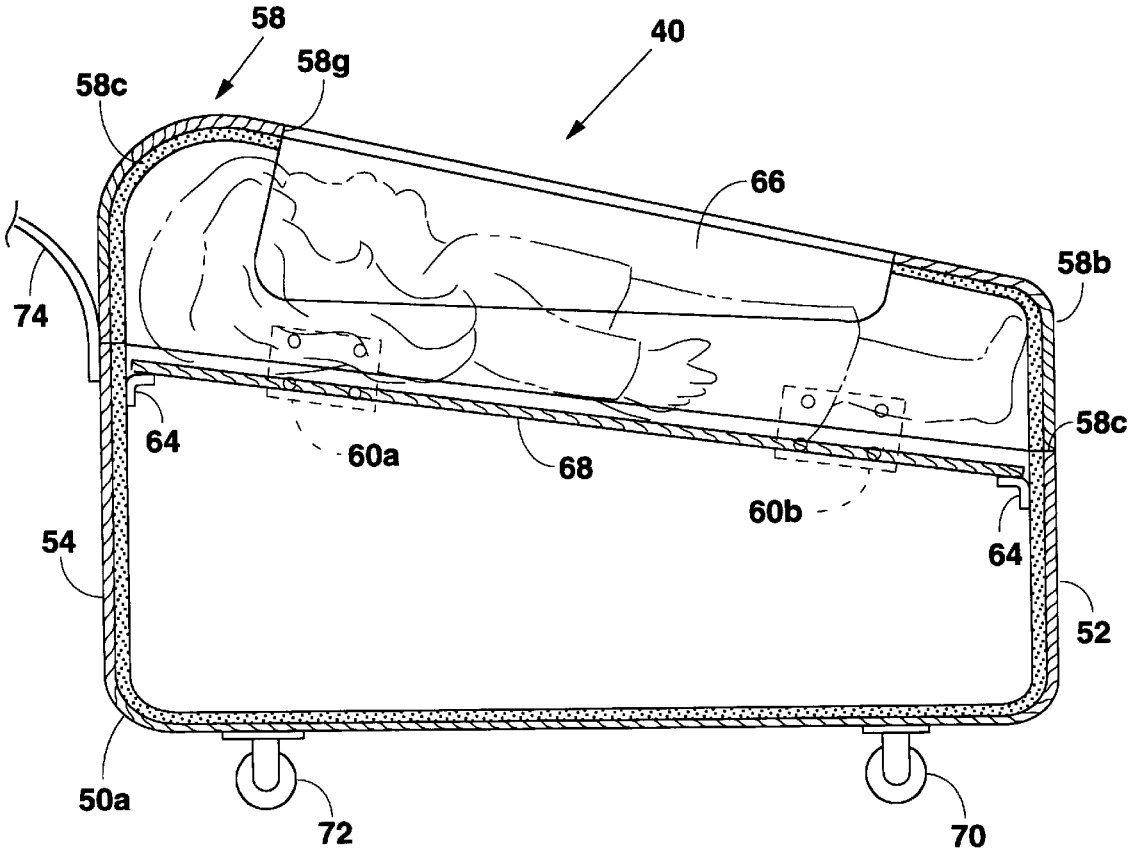
FIG. 8 is a vertical sectional view taken through the longitudinal center of FIG. 6.

The now preferred embodiment of the present invention shown in FIG. 6, is a doll travel case 40 comprising a bottom wall 50 of generally rectangular configuration, but with the corners rounded to remove sharp adjoining edges and improve the appearance of the travel case. Bottom wall 50 has a forward edge 50*a* and an oppositely spaced rearward edge 50*b* (FIG. 8). Forward edge 50*a* preferably has a greater longitudinal length than rearward edge 50*a*. Upstanding end walls 52 and 54 respectively have lower edges connected to the forward edge 50*a* and rearward edge 50*b* of bottom wall 50. Rearward wall 52 is substantially equal to or somewhat shorter in height than wall 54. Doll case 40 has side walls 55 and 56 oppositely spaced with the bottom edge of each side wall respectively secured to the longitudinal edges of the generally rectangular bottom wall 50. Side walls 55 and 56 are integrally connected with end walls 52 and 54 to generally form a bottom enclosure that has a continuous perimetrical top edge 50*c* that lies in a common plane.

A dome cover 58 has a bottom edge 50*f* perimetrically abuttable with perimetrical top edge 50*c* of the bottom enclosure as shown in FIG. 6. Dome 58 has a substantially arcuate vertical cross-section configuration comprising a top wall 58*a* that has interconnected and depending front 58*c*, rear 58*b*, first side 58*d*, and a second side 58*e* walls. These depending walls define a generally rectangular bottom periphery 58*f* conforming to the shape of perimetrical top edge 50*c* of the bottom enclosure. Preferably, the front depending wall 58*c* is of greater height than the rearwall 58*b*, or vice versa.

A pair of hinges 60*a* and 60*b* (FIG. 8) are mounted, aligned, and oppositely spaced along the longitudinal length of one side wall 58*e*. Those hinges interconnect side wall 58*e* of the dome cover 58 to side wall 56 of the bottom enclosure. These hinges allow dome 58 to be moved in a generally vertical plane from a closed position abutting top edge 50*c* of the bottom enclosure, FIG. 6, to an open position, FIG. 7. Dome 58 in the open position provides access to the interior of the bottom enclosure. A pair of connecting clasps 62*a* and 62*b* are mounted, aligned, and oppositely spaced along the longitudinal length of a dome side wall 58*d* and the adjacent upstanding wall 55. Those clasps detachably secure first side wall 58*d* and side wall 55 of the bottom enclosure when dome 58 is in the closed position.

Dome 58 has a generally curving shape that defines its top wall and its interconnected depending side walls. Top wall 58*a* has a large centrally located aperture 58*g*. Aperture 58*g* conforms to the general curve of top wall 58*a* and extends partially into first and second side walls 58*d* and 58*e* respectfully. Aperture 58*g* is closed by an overlying panel of a clear transparent and rigid plastic material 66. Plane 66 is curved in the vertical plane to conform to the contour of the top wall 58*a* and the extension of aperture 58*g* into side walls 58*d* and 58*e* respectively. Panel 66 may, if desired, be made of one of the well-known acrylic plastics. Panel 66 has its peripheral edge secured to the edges of the aperture 58*e* by any suitable means.

Figure 7:
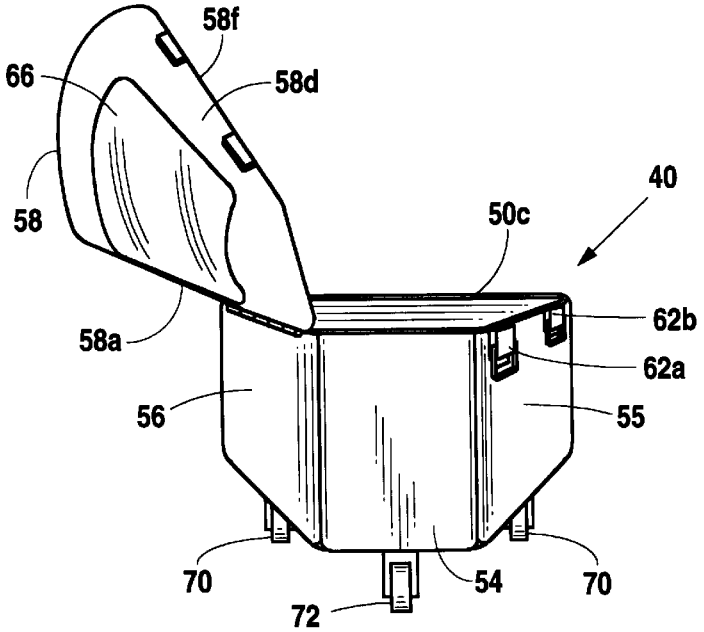
FIG. 7 is a reduced scale, perspective view of the doll case as illustrated in FIG. 6 with the dome cover in an open position.

The doll is inserted into the travel case 40 by pivoting dome 58 upwardly as shown in FIG. 7, thereby gaining access to the interior of the bottom enclosure of travel case 40.

Travel case 40 has inwardly projecting ribs providing an inclined peripheral ledge 64 that is suitably formed on, or adhesively secured around the interior of the upstanding walls. Ledge 64 is positioned above bottom wall 50 and sufficiently below top edge 50*c* to permit the doll to be laid on a rigid shelf 68 that is supported on ledge 64. Alternatively shelf 68 may, if desired, be removed and the doll then positioned in case 40 as shown in FIG. 2. It should be noted that shelf 68 is inclined to generally follow the longitudinally inclined contour of dome 58. Accordingly, the doll will be in a position where the head of the doll is above the rear wall and aligned with the transparent dome cover. Thus, the doll can be readily observed by the doll owner and the doll can "see" through transparent cover 66 and observe her surroundings.

Since the luggage utilized by many parents often involves wheels and a pull strap, a pair of transversely spaced wheels 70 may be provide in depending relationship to bottom wall 50 and located adjacent to rear wall 52. A third wheel 72 may be provided on bottom wall 50 adjacent to forward wall 54 permitting case 40 to readily roll on the surface normally encountered in an airport, bus terminal, or train depot. Lastly, a pull strap 74 may be suitably secured to the upper portion of forward wall 54 to permit the doll owner to readily pull the travel case 40 through the airport.

Travel case 40 may be constructed in accordance with any one of several well-known methods of fabricating travel luggage. Those methods have been previously discussed. Any of the techniques presently available in the art of manufacturing luggage may be employed to fabricate travel case 40. The now preferred modification can be readily fabricated by separate injection molds for the lower enclosure and the dome cover.

Other modifications of the invention will be readily apparent to those skilled in the art, and it is intended that all such modifications be included within the scope of the appended claims.

I claim:

1. A travel case for a doll comprising, in combination:

a horizontal, generally rectangular base having two opposed end edges and two opposed side edges;

a pair of upstanding end walls respectively secured to said end edges;

one said end wall having a height substantively less than the other said end wall;

a pair of upstanding side walls respectively secured to said side edges of said base;

each of said upstanding end walls being integrally united with the adjoining upstanding side walls;

each of said upstanding side walls having an inclined top edge extending from the lower one of said end walls to the higher one of said end walls;

a top wall having a perimeter non-detachably secured to the top edges of said upstanding side and edge walls, thereby defining a cover for said side and end walls that is inclined relative to said horizontal base;

said top wall defining an opening of a size sufficient to permit insertion of a doll therethrough;

a transparent flap dimensioned to overlie said top wall opening;

means for detachably securing said transparent flap to said top wall to repeatedly open and close said opening but permit observation of an inserted doll; and a shelf detachably mounted between said sidewalls and said end walls in an inclined position generally parallel to said top wall, whereby a doll may be laid on said shelf and doll clothes may be packed in the case beneath said shelf.

2. The apparatus of claim 1 wherein said transparent flap has a small portion of its periphery foldably secures to said top wall so as to be pivotally moveable between an open position relative to said top opening and a closed position overlying said top opening; and means on the remaining periphery of said transparent flap for detachable securement to portions of said top wall surrounding said opening.

3. A travel case for a doll comprising:

a generally rectangular bottom wall having to opposed end edges and two opposed side edges;

a plurality of rollers depending from said bottom wall to permit movement of the case in a direction generally parallel to the length dimension of said bottom wall;

upstanding interconnected walls respectively secured to said end edges and said side edges of said bottom wall;

one of said end walls being of lesser height than the other said end wall;

said side walls having top edges inclined to respectively connect between said one end wall and said other end wall;

a doll supporting shelf detachably mounted between said side walls and said end walls;

said shelf being spaced above and inclined relative to said bottom wall to support the doll's head in an elevated position relative to the top of said one end wall;

a top wall including a transparent portion; and means for mounting said top wall to said top edges of said sidewalls to enclose said doll in the travel case with its head aligned with said transparent portion to permit the doll to "see" its surroundings.

4. A travel case for a doll comprising a generally rectangular bottom wall having two opposed end edges and two opposed side edges;

upstanding interconnected walls respectively connected to each of said end edges and side edges to form front, rear, and two side walls;

said upstanding walls having top edges lying substantially in a common plane;

a dome shaped cover having a substantially accurate vertical cross-section and interconnected depending portions around the perimeter of said cover defining a generally rectangular bottom periphery conforming to and abuttable with said top edges of said upstanding walls;

one of said upstanding front and rear walls being of greater height than the other, whereby said cover slopes downwardly from said one upstanding wall of the travel case to said other upstanding wall;

said cover having an aperture therein;

a sheet of transparent material covering said aperture;

said sheet being curved in a vertical plane to conform to the contour of said cover;

whereby a doll placed in said case with its head aligned with said transparent sheet may "see" its surroundings.

* * * * *